US005607136A

United States Patent [19]

Bernloehr

[11] Patent Number: 5,607,136

[45] Date of Patent: Mar. 4, 1997

[54] OMNI-DIRECTIONAL BREAKAWAY MOUNTING DEVICE FOR TROLLING MOTOR

[75] Inventor: Darrel Bernloehr, Mankato, Minn.

[73] Assignee: Johnson Fishing, Inc., Mankato, Minn.

[21] Appl. No.: 253,767

[22] Filed: Jun. 3, 1994

[51] Int. Cl.[6] ..... F16M 3/00

[52] U.S. Cl. ..... 248/640; 440/56

[58] Field of Search ..... 248/642, 640, 248/641, 643; 440/6, 63, 56

[56] References Cited

U.S. PATENT DOCUMENTS

| | | | |
|---|---|---|---|
| 1,703,099 | 2/1929 | Craddock . | |
| 3,119,365 | 1/1964 | Evans . | |
| 3,377,978 | 4/1968 | Tillman | 440/56 |
| 3,698,672 | 10/1972 | Gilbert | 440/56 X |
| 3,724,790 | 4/1973 | Harris et al. . | |
| 3,915,417 | 10/1975 | Norton | 440/56 X |
| 4,019,703 | 4/1977 | Meredith | 440/56 X |
| 4,033,530 | 7/1977 | Harris | 440/56 X |
| 4,094,482 | 6/1978 | Weaver . | |
| 4,175,724 | 11/1979 | Bauman | 248/642 |
| 4,268,258 | 5/1981 | Beem . | |
| 4,548,586 | 10/1985 | Phillips, Jr. . | |
| 4,555,233 | 11/1985 | Klammer et al. | 440/56 |
| 4,729,745 | 3/1988 | Edwards . | |
| 4,734,068 | 3/1988 | Edwards . | |
| 4,819,905 | 4/1989 | McCain . | |
| 4,911,398 | 3/1990 | DiIulio et al. . | |
| 4,955,834 | 9/1990 | Henderson et al. . | |
| 4,966,566 | 10/1990 | Baird | 440/63 X |
| 5,116,267 | 5/1992 | Olson . | |

FOREIGN PATENT DOCUMENTS

| | | | |
|---|---|---|---|
| 923367 | 4/1963 | United Kingdom | 440/56 |

*Primary Examiner*—Ramon O. Ramirez
*Attorney, Agent, or Firm*—Foley & Lardner

[57] ABSTRACT

A breakaway mounting device for a trolling motor, such as an electric trolling motor, includes a support frame adapted for coupling to a mounting assembly on the bow of a fishing boat. An omni-directional swivel joint is provided in the support frame for receiving the motor's support tube. The swivel joint preferably includes a spherical bearing surface formed in the frame and a spherical bearing member conforming to the bearing surface to permit pivotal movement of the trolling motor. A biasing assembly is also provided in the frame and cooperates with the swivel joint to urge the support tube of the trolling motor into its normal operating position, while allowing angular displacement of the support tube with respect to the normal operating position when the trolling motor impacts a submerged obstruction. The biasing assembly preferably includes a concave biasing surface formed in the frame and opening toward the bearing surface, a convex biasing member cooperating with the biasing surface, and a compression member that urges the biasing member toward the biasing surface. The mount permits angular breakaway action in any radial direction and offers self-centering realignment of the trolling motor after the trolling motor is freed from the obstruction.

18 Claims, 3 Drawing Sheets

OMNI-DIRECTIONAL BREAKAWAY MOUNTING DEVICE FOR TROLLING MOTOR

BACKGROUND OF THE INVENTION

1. Field of the Invention

The present invention relates generally to a device for mounting a trolling motor to the bow of a boat and, more particularly, to a breakaway mount for a trolling motor that positions the motor to transmit thrust to the boat under normal operating conditions and permits angular displacement of the motor from the normal operating position in any direction in response to impact of the motor with submerged objects.

2. Description of Related Art

Trolling motors for fishing boats, especially electric trolling motors, have become an extremely popular accessory for both competitive anglers and casual hobbyists. Due to their lightweight design and quiet operation such motors permit anglers to access remote and shallow spots, such as near shorelines. Remote steering systems provide a high degree of maneuverability without distracting the user's attention from fishing. However, trolling motors have long been plagued by their vulnerability to impact with submerged objects such as tree stumps, roots, rocks and the like. Such impacts can cause permanent damage to the trolling motor, the mounting structure, the boat itself, or to all three.

A number of improvements have been proposed to enhance the ruggedness and resistance of trolling motors to impact with submerged objects. These improvements have involved modifications in the design of both trolling motors themselves and the mounting arrangements used to suspend the motors from the bow of a fishing boat. One such improvement involves the use of a flexible suspension tube between the boat mount and the underwater drive unit. When the drive unit contacts a submerged object the tube flexes elastically to avoid permanent damage. This flexure is generally limited by the size and material used in constructing the tube. While effective at preventing damage from relatively minor impacts, however, the use of a flexible tube alone does not avoid damage from more serious impacts.

A number of other improvements aim at providing a "breakaway mount" that allows the entire trolling motor assembly to swing or pivot upon impact with a submerged object. Known breakaway mounts for trolling motors generally include a bracket assembly that is bolted to the bow of a boat. In one known breakaway mount a clamp is pivotally mounted to the bracket assembly and a pair of nested channel members cooperate with the clamp to hold the motor in a vertical operating position. The channel members can slide with respect to one another to allow pivotal movement of the clamp and trolling motor upon impact with a submerged object. The force required to cause the sliding movement of the channel members may be adjustable. In another known design, a similar bracket assembly is bolted to the boat and supports a vertical bearing plate mounted on an array of generally horizontal compression springs. The compression springs surround alignment bolts and cooperate with the bolts to hold the bearing plate in its normal vertical operating position, while permitting some shock absorbing movement of the plate. A trolling motor tube is clamped to the plate and may move angularly by compression of the springs. A mount of the latter type is described in U.S. Pat. No. 4,555,233 issued on Nov. 26, 1985 to Klammer et at. and assigned to the assignee of the present application.

While such mounts provide some degree of protection, they are generally only responsive to forces oriented in their direction of pivot (i.e. front to back), or within a fairly narrow range on either side of that direction, wherein the force component in the direction of pivot is sufficient to cause the sliding movement or spring compression. However, because the trolling motor may be steered well beyond the range of operation of the mount, such as during lateral or turning maneuvers, impacts are possible that will not cause the mount to breakaway, thereby resulting in possible damage to the motor, the mounting assembly and the boat. Moreover, even where adjustable sliding breakaway mounts pivot as designed, they must be manually reset to their normal operating position and may require the user to reset the breakaway force by turning a threaded bolt, further distracting the angler from fishing.

The present invention is directed to overcoming or minimizing the drawbacks of existing trolling motor breakaway mounts. In particular, the invention is directed to a breakaway mount for a trolling motor that biases or urges the motor into its normal operating position, but that allows angular displacement of the motor in response to impact with a submerged obstruction in any direction, that is omni-directionally. In addition, the invention provides a breakaway mount that automatically returns the motor to its normal operating position without requiting intervention from the user or adjustment of the breakaway force.

SUMMARY OF THE INVENTION

In accordance with one aspect of the invention, there is provided a breakaway mounting device for a trolling motor of the type including a support tube and a submergible drive unit coupled to the tube. The mounting device includes a support frame and an omni-directional swivel joint coupled to the support frame for receiving the support tube and for positioning the drive unit underwater. The device also includes a biasing assembly coupled to the frame and cooperating with the swivel joint to urge the support tube into a normal operating position and to permit angular displacement of the support tube with respect to the normal operating position.

In accordance with another aspect of the invention, a mounting device for a trolling motor is provided that includes a frame adapted for mounting to the bow of a boat. The frame has a bearing surface with a concave spherical configuration and a biasing surface having a concave configuration opening toward the bearing surface. The bearing surface and the biasing surface share a common substantially vertical axis. The device also includes a convex spherical pivot bearing member and a convex biasing member. The bearing member has a central axis and a first central aperture surrounding the central axis, while the biasing member has a central axis coincident with the central axis of the bearing member and a second central aperture surrounding the central axis. In addition, the device includes a compression member disposed intermediate the bearing member and the biasing member for urging the beating member and the biasing member against the bearing surface and the biasing surface respectively, whereby the central axis of the bearing member and the biasing member is urged into alignment with the axis of the bearing surface and the biasing surface.

In accordance with a further aspect of the invention, there is provided an omni-directional breakaway mounting device comprising support means for suspending the motor from a boat, pivot means for permitting omni-directional angular displacement of the support tube in response to impact of the motor drive unit with a submerged obstruction, and biasing means for urging the support tube into a normal operating position.

BRIEF DESCRIPTION OF THE DRAWINGS

The present invention will become more fully understood from the following detailed description, taken in conjunction with the accompanying drawings, wherein like reference numerals refer to,like parts, in which.

DESCRIPTION OF THE PREFERRED EMBODIMENTS

Figure 1:
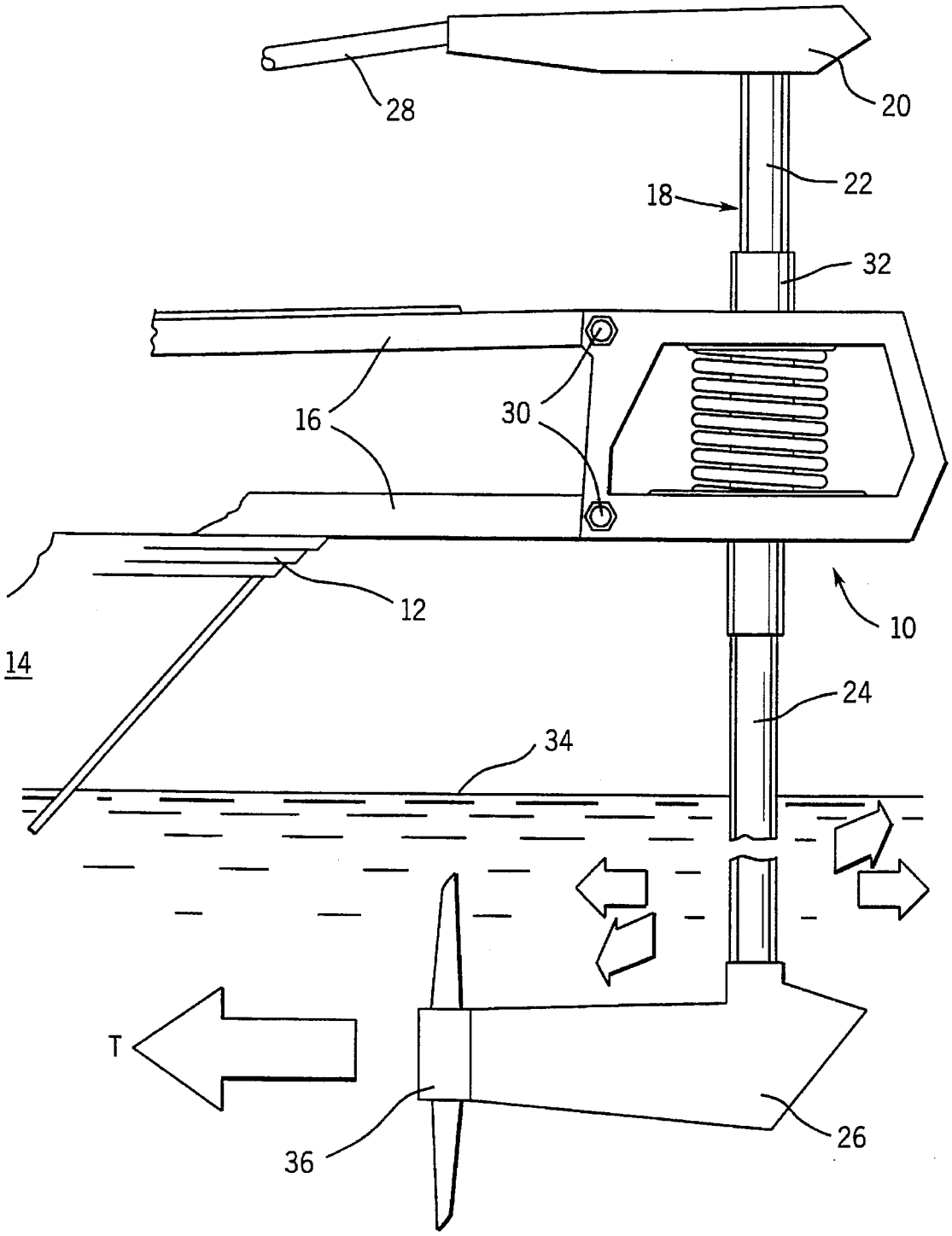
FIG. 1 is a schematic illustration of an omni-directional breakaway mounting device in accordance with the invention mounted to the bow of a fishing boat.

Turning now to the drawings and referring to FIG. 1, an omni-directional breakaway mounting device 10 is illustrated mounted to the bow 12 of a fishing boat 14 by a bracket assembly 16. Bracket assembly 16 and mounting device 10 cooperate to hold a trolling motor 18 in a substantially vertical operating position. Trolling motor 18 is of the type including a steering head 20, a support tube 22, a rotatable steering tube 24 and a submergible drive unit 26. Steering head 20 is coupled to a remote steering device (not shown) via control cables 28 for steering drive unit 26 by rotation of steering tube 24. Bolts 30 hold mounting device 10 on bracket assembly 16 and permit removal of mounting device 10 for servicing. Bolts 30 could be replaced with pins secured by spring clips for rapid removal of mounting device 10. As illustrated in FIG. 1, mounting device 10 holds a hollow sleeve 32 that, in turn, receives support tube 22.

In operation, drive unit 26 is deployed under the surface 34 of a body of water and a screw prop 36 on drive unit 26 produces a thrust T to propel and steer boat 14. It will be appreciated that, because trolling motor 18 may be steered through a full circle, thrust T may be directed in any orientation (i.e. forward, backward or at any orientation therebetween). Mounting device 10 urges trolling motor 18 into the normal operating position illustrated in FIG. 1, effectively resisting the moment created by thrust T. As will be discussed in greater detail below, when trolling motor 18 contacts a submerged obstacle (not shown) with sufficient force to create a threshold breakaway moment, mounting device 10 permits trolling motor 18 to pivot angularly from the normal operating position. Moreover, the angular displacement of trolling motor 18 may be in any direction, thereby providing breakaway protection regardless of the orientation of drive unit 26 or the direction of movement of boat 14.

Figure 2:
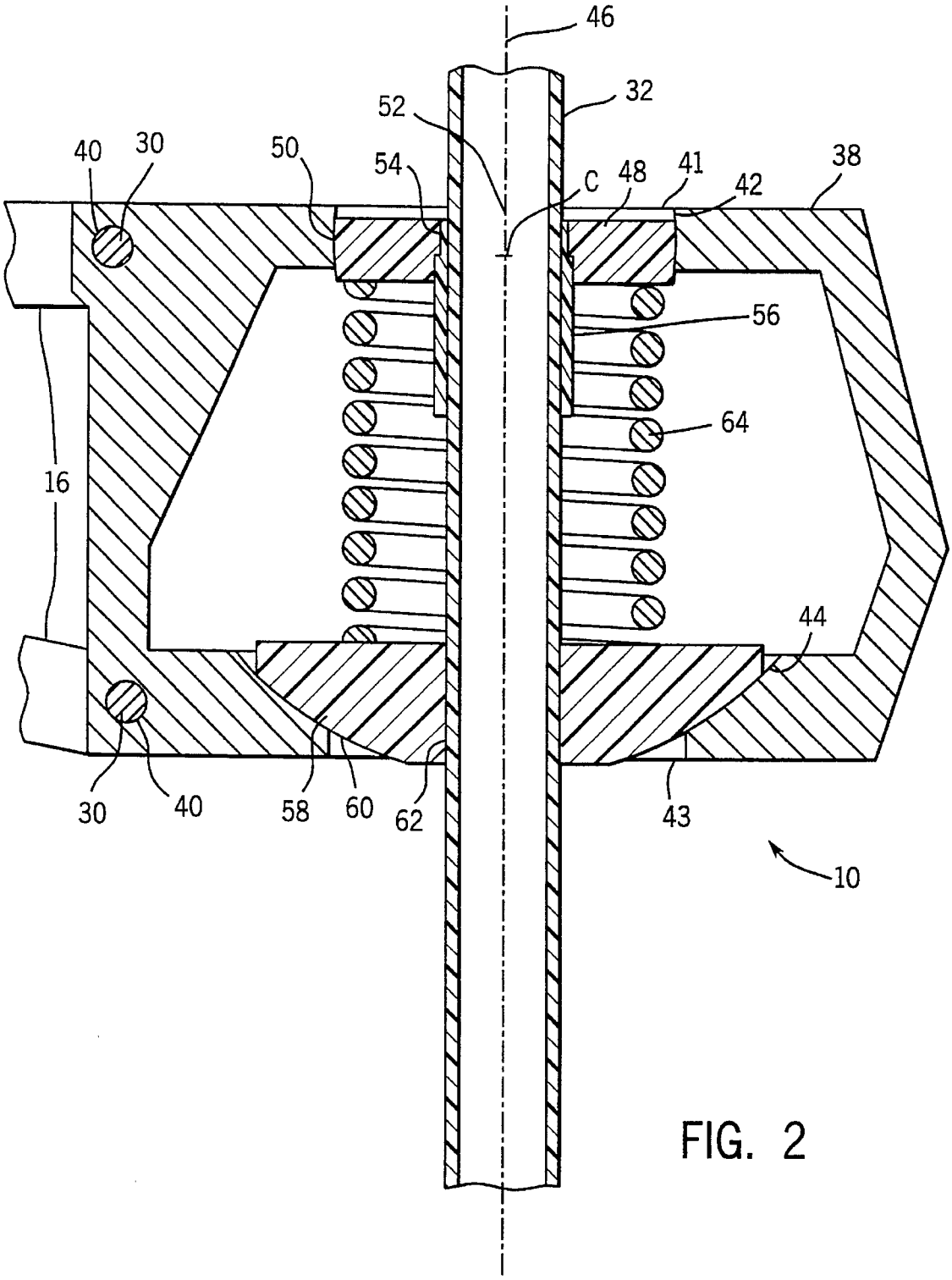
FIG. 2 is a sectional view through the mounting device shown in FIG. 1, depicting the various parts of the mounting device in the biased or normal operating position.

As illustrated in FIG. 2, in the presently preferred embodiment mounting device 10 includes a frame 38 having machined bores 40 for receiving bolts 30 for securing device 10 to bracket assembly 16. Frame 38 may be a box-like cast or assembled structure, and is preferably made of a corrosion resistant metal such as anodized aluminum or stainless steel. Frame 38 includes a circular upper opening 41, the edge of which forms a concave bearing surface 42. Frame 38 also includes a circular lower opening 43, the edge of which forms a concave biasing surface 44. Beating surface 42 has a generally spherical or spherical segment configuration, the radius of which determines the location of the pivotal center C of mounting device 10. Biasing surface 44 may have a curved configuration as shown in FIG. 2, or a frusto-conical configuration. In either case, biasing surface 44 opens toward beating surface 42, and both surfaces 42, 44 share a common axis 46 that is oriented substantially vertically when mounting device 10 is in its deployed position.

A spherical beating member 48 is positioned within frame 38 and is provided with a spherical convex bearing surface 50 conforming to concave bearing surface 42. Bearing member 48 has a central axis 52, coincident with axis 46 in the normal operating position and angularly displaced with respect to axis 46 in breakaway positions (see FIG. 3). Beating member 48 includes a central aperture 54 surrounding axis 52 for receiving sleeve 32. A reinforcing bushing 56 is preferably provided in aperture 54 to lend support to the assembly of sleeve 32 in aperture 54, particularly during breakaway displacement of bearing member 48 as will be discussed below. A biasing member 58 is also positioned within frame 38 and is provided with a convex biasing surface 60 configured to cooperate with concave biasing surface 44. In the assembled mounting device 10, biasing member 58 shares central axis 52 with bearing member 48, and includes a central aperture 62 surrounding axis 52 for slidably receiving sleeve 32. Bearing member 48 and biasing member 58 are preferably made of a self-lubricating plastic material, such as TEFLON, that is sufficiently rigid to withstand the forces encountered in operation of mounting device 10 and resists permanent deformation during long periods of non-use.

A compression member 154, such as a coil spring, is disposed within frame 38 intermediate bearing member 48 and biasing member 58 and surrounding sleeve 32. Compression member 64 is compressed upon assembly of mounting device 10 to cause compression member 64 to seat and press against bearing member 48 and biasing member 58. In the normal operating position illustrated in FIG. 2, compression member 64 exerts a predetermined constant force on both bearing member 48 and biasing member 58 to urge bearing member 48 and biasing member 58 against bearing surface 42 and biasing surface 44 respectively.

Figure 3:
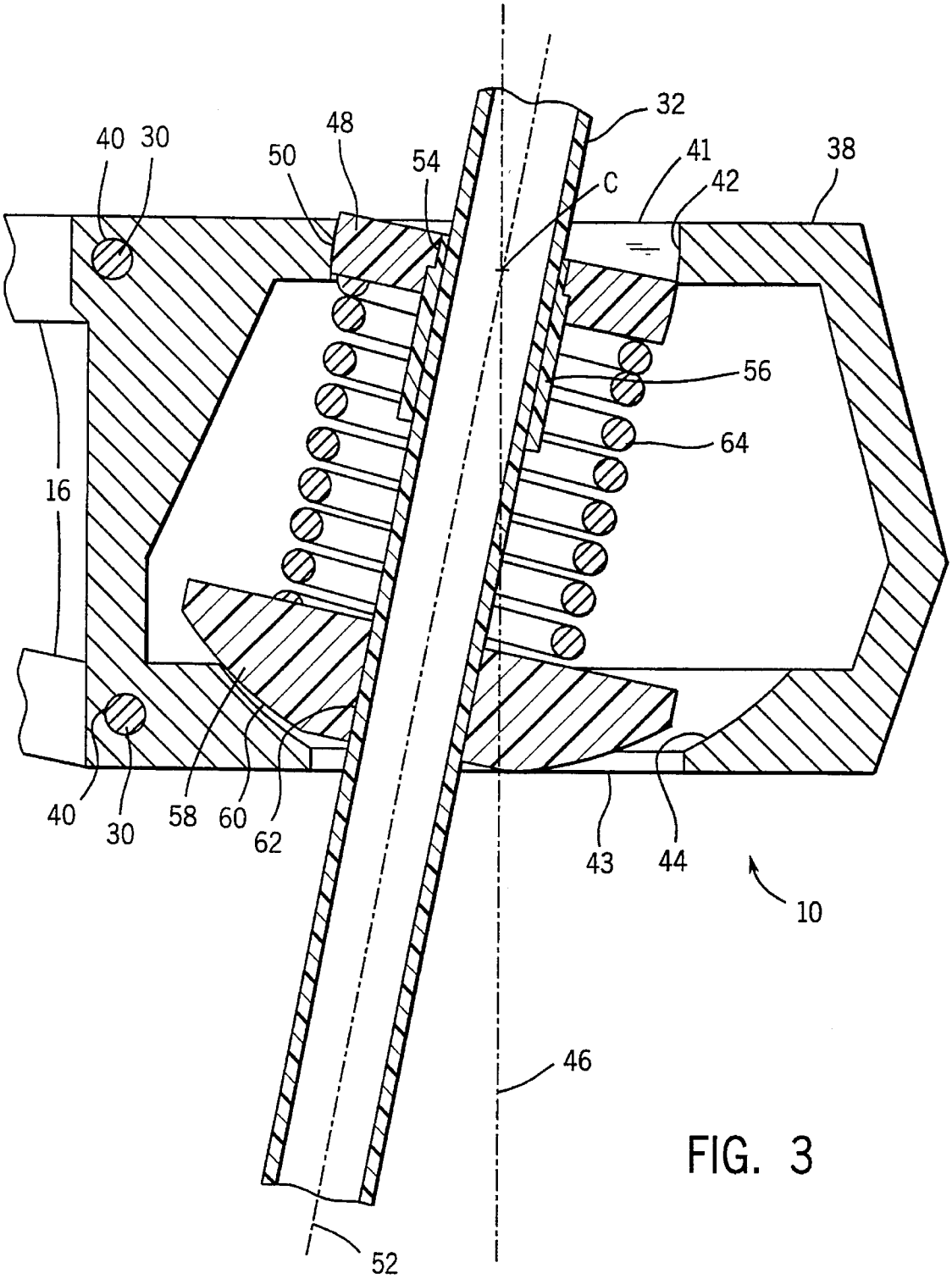
FIG. 3 is a sectional view of the mounting device shown in FIG. 2, illustrating the breakaway or pivoted position of the device.

When a trolling motor installed in mounting device 10 contacts a submerged object with a sufficient force to disengage biasing member 58 from biasing surface 44, mounting device 10 permits angular displacement of the motor as illustrated in FIG. 3. As the central axis 52 of bearing member 48 and biasing member 58 is displaced angularly with respect to the axis 46 of bearing surface 42 and biasing surface 44, bearing member 48 pivots about pivotal center C and biasing surface 44 forces biasing member 58 to slide upwardly along sleeve 32 against the force of compression member 64. When the obstruction is cleared, biasing member 58 once again urges sleeve 32 toward the normal operating position. Due to the radial symmetry of bearing surface 42, bearing member 48, biasing surface 44 and biasing member 58, this breakaway and recentering action may be oriented in any radial direction about axis 46.

The specific geometry of the various elements of mounting device 10, and the spring constant of compression member 64 are selected interdependently based upon the degree of angular displacement desired and the desired forces for disengaging and recentering biasing member 58.

In the present embodiment, axis 52 may be displaced with respect to axis 46 a maximum of about 12.5 degrees in any direction. Moreover, biasing member 58 effectively converts a portion of the force exerted by compression member 64 into a radial component that acts on biasing surface 44 to urge the trolling motor into the normal operating position. Hence, the spring constant of compression member 64 must be sufficiently high to cause compression member 64 to exert a force on biasing member 58 sufficient to produce a radial component capable of resisting the moment caused by the normal thrust of the trolling motor without disengaging. Furthermore, the spring constant of compression member 64 must be sufficiently low to permit disengagement of biasing member 58 and angular displacement of the motor before permanent damage can occur due to impact with a submerged object. The latter threshold generally depends upon the strength of the motor support tube (i.e. disengagement should occur before permanent deformation of the tube). Finally, the geometries of biasing surface 44 and biasing member 58 are selected to obtain the desired breakaway, or disengagement moment threshold as well as the desired recentering moment. It has been found that the combination of a concave frusto-conical biasing surface 44 in frame 38 with a curved convex biasing surface 60 on biasing member 58 provides good "snap-action" recentering, effectively driving or wedging biasing member 58 into the normal operating position.

While the invention is susceptible to various modifications and alternative forms, specific embodiments have been shown and described by way of example in the foregoing drawings and detailed description. However, it should be understood that the invention is not intended to be limited to the particular forms disclosed. Rather, the invention is intended to cover all modifications, equivalents and alternatives falling within the spirit and scope of the invention as defined by the appended claims. For example, the spherical bearing arrangement described could be replaced by any other suitable omni-directional swivel device, such as a two-axis universal joint type swivel.

We claim:

1. A breakaway mounting device for a trolling motor, the motor being of the type including a support tube and s submergible drive unit coupled to the support tube, the device comprising:

a support frame;

an omni-directional swivel joint coupled to the support frame for receiving the support tube and for positioning the drive unit underwater;

a biasing assembly coupled to the frame and cooperating with the swivel joint to urge the support tube into a normal operating position and to permit angular displacement of the support tube with respect to the normal operating position; and a cylindrical sleeve for receiving the support tube, the sleeve extending intermediate the swivel joint and the biasing assembly.

2. A breakaway mounting device for a trolling motor, the motor being of the type including a support tube and s submergible drive unit coupled to the support tube, the device comprising:

a support frame;

an omni-directional swivel joint coupled to the support frame for receiving the support tube and for positioning the drive unit underwater;

a biasing assembly coupled to the frame and cooperating with the swivel joint to urge the support tube into a normal operating position and to permit angular displacement of the support tube with respect to the normal operating position, wherein the omni-directional swivel joint includes a concave spherical bearing surface formed in the support frame and having a substantially vertical axis, and a convex spherical bearing member having a central axis and a first central aperture surrounding the central axis for receiving the support tube; and wherein the biasing assembly includes a concave biasing surface formed in the support frame and having an axis coincident with the axis of the bearing surface, a convex biasing member having a central aperture for receiving the support tube, and a compression member extending intermediate the bearing member and the biasing member for urging the bearing member and the biasing member against the bearing surface and the biasing surface respectively.

3. An omni-directional breakaway mounting device for an electric trolling motor, the motor being of the type including a support tube and a submergible drive unit coupled to the support tube, the device comprising:

support means for suspending the motor from a boat;

pivot means for permitting omni-directional angular displacement of the support tube in response to impact of the drive unit with a submerged obstruction;

biasing means for urging the support tube into a normal operating position, wherein the pivot means include a concave spherical bearing surface and a convex spherical bearing member having a central aperture for receiving the support tube.

4. A breakaway mounting device for a trolling motor, the motor being of the type including a support tube and s submergible drive unit coupled to the support tube, the device comprising:

a support frame;

an omni-directional swivel joint coupled to the support frame for receiving the support tube and for positioning the drive unit underwater;

a biasing assembly coupled to the frame and cooperating with the swivel joint to urge the support tube into a normal operating position and to permit angular displacement of the support tube with respect to the normal operating position, wherein the biasing assembly includes a concave biasing surface formed in the support frame, a convex biasing member having a central aperture for receiving the support tube, and a compression member cooperating with the biasing member to urge the biasing member against the biasing surface.

5. A breakaway mounting device as recited in claim 4 wherein the biasing surface and the biasing member each have a curved configuration.

6. A breakaway mounting device for a trolling motor, the motor being of the type including a support tube and s submergible drive unit coupled to the support tube, the device comprising:

a support frame;

an omni-directional swivel joint coupled to the support frame for receiving the support tube and for positioning the drive unit underwater;

a biasing assembly coupled to the frame and cooperating with the swivel joint to urge the support tube into a normal operating position and to permit angular displacement of the support tube with respect to the normal operating position, wherein the omni-directional swivel joint includes a concave spherical bearing surface formed in the support frame, and a convex spherical bearing member having a central aperture for receiving the support tube.

7. A breakaway mounting device as recited in claim 6 wherein the biasing surface and the biasing member each have a frusto-conical configuration.

8. A breakaway mounting device as recited in claim 6 wherein the biasing surface has a frusto-conical configuration and the biasing member has a curved configuration.

9. A mounting device for a trolling motor, the motor being of the type coupled to a support tube for suspending the motor under water from the bow of a boat and for transmitting thrust to the boat, the device comprising:

a frame adapted for mounting to the bow, the frame having a bearing surface and a biasing surface, the bearing surface having a concave spherical configuration, the biasing surface having a concave configuration opening toward the bearing surface, the bearing surface and the biasing surface sharing a common substantially vertical axis;

a convex spherical pivot bearing member having a central axis and a first central aperture surrounding the central axis;

a convex biasing member having a central axis coincident with the central axis of the bearing member and a second central aperture surrounding the central axis; and a compression member disposed intermediate the bearing member and the biasing member, the compression member urging the bearing member and the biasing member against the bearing surface and the biasing surface respectively, whereby the central axis of the bearing member and the biasing member is urged into alignment with the axis of the bearing surface and the biasing surface.

10. A mounting device for a trolling motor as recited in claim 9 further comprising a cylindrical sleeve for receiving the support tube, the sleeve extending around the central axis and being received in the first central aperture of the bearing member and in the second central aperture of the biasing member.

11. A mounting device for a trolling motor as recited in claim 9 wherein the biasing surface and the biasing member each have a curved configuration.

12. A mounting device for a trolling motor as recited in claim 9 wherein the biasing surface and the biasing member each have a frusto-conical configuration.

13. A mounting device for a trolling motor as recited in claim 9 wherein the biasing surface has a frusto-conical configuration and the biasing member has a curved configuration.

14. An omni-directional breakaway mounting device for an electric trolling motor, the motor being of the type including a support tube and a submergible drive unit coupled to the support tube, the device comprising:

support means for suspending the motor from a boat;

pivot means for permitting omni-directional angular displacement of the support tube in response to impact of the drive unit with a submerged obstruction;

biasing means for urging the support tube into a normal operating position, and further comprising alignment means intermediate the pivot means and the biasing means for receiving the support tube.

15. An omni-directional breakaway mounting device for an electric trolling motor, the motor being of the type including a support tube and a submergible drive unit coupled to the support tube, the device comprising:

support means for suspending the motor from a boat;

pivot means for permitting omni-directional angular displacement of the support tube in response to impact of the drive unit with a submerged obstruction;

biasing means for urging the support tube into a normal operating position, wherein the biasing means include a concave biasing surface, a convex biasing member having a central aperture for receiving the support tube, and a compression member cooperating with the biasing member to urge the biasing member against the biasing surface.

16. An omni-directional breakaway mounting device as recited in claim 15 wherein the biasing surface and the biasing member each have a curved configuration.

17. An omni-directional breakaway mounting device as recited in claim 15 wherein the biasing surface and the biasing member each have a frusto-conical configuration.

18. An omni-directional breakaway mounting device as recited in claim 15 wherein the biasing surface has a frusto-conical configuration and the biasing member has a curved configuration.

* * * * *